US008348712B2

(12) United States Patent
De La Torre

(10) Patent No.: US 8,348,712 B2
(45) Date of Patent: Jan. 8, 2013

(54) TOY WITH AUDIO AND VISUAL FEEDBACK

(75) Inventor: Gabriel De La Torre, Bell Gardens, CA (US)

(73) Assignee: Mattel, Inc., El Segundo, CA (US)

( * ) Notice: Subject to any disclaimer, the term of this patent is extended or adjusted under 35 U.S.C. 154(b) by 406 days.

(21) Appl. No.: 12/581,643

(22) Filed: Oct. 19, 2009

(65) Prior Publication Data

US 2010/0099326 A1 Apr. 22, 2010

Related U.S. Application Data

(60) Provisional application No. 61/106,548, filed on Oct. 17, 2008.

(51) Int. Cl.
*A63H 27/00* (2006.01)

(52) U.S. Cl. ..... 446/34; 446/242; 446/438; 446/175

(58) Field of Classification Search ..... 446/34, 446/57, 242, 438, 175
See application file for complete search history.

(56) References Cited

U.S. PATENT DOCUMENTS

| | | | | |
|---|---|---|---|---|
| 5,356,328 | A * | 10/1994 | Ho | 446/242 |
| 5,720,651 | A * | 2/1998 | Chien | 451/95 |
| 5,791,966 | A * | 8/1998 | Capps et al. | 446/242 |
| 6,361,393 | B1 * | 3/2002 | Seymour | 446/34 |
| 6,565,242 | B2 * | 5/2003 | Dai | 362/500 |
| 6,592,423 | B1 * | 7/2003 | Boyle et al. | 446/175 |
| 6,755,716 | B2 * | 6/2004 | Agostini et al. | 446/435 |
| 6,921,313 | B2 * | 7/2005 | Yu | 446/39 |
| 6,994,605 | B2 * | 2/2006 | Baxter et al. | 446/236 |
| 7,001,053 | B1 * | 2/2006 | Chieh et al. | 362/500 |
| 7,037,169 | B2 * | 5/2006 | Benedek et al. | 446/242 |
| 7,081,828 | B2 * | 7/2006 | Low | 340/815.45 |
| 7,108,576 | B2 * | 9/2006 | LaPointe | 446/47 |
| 7,361,074 | B1 | 4/2008 | Periman et al. | |
| 7,731,561 | B2 * | 6/2010 | Chernick et al. | 446/369 |
| 7,766,718 | B2 * | 8/2010 | Rago et al. | 446/242 |
| 2004/0022070 | A1 | 2/2004 | Moore | |
| 2007/0049159 | A1 * | 3/2007 | Kulis | 446/438 |
| 2007/0254553 | A1 * | 11/2007 | Wan | 446/175 |
| 2009/0068919 | A1 * | 3/2009 | Jermyn | 446/57 |

FOREIGN PATENT DOCUMENTS

| | | | |
|---|---|---|---|
| JP | 5228265 | A | 9/1993 |
| KR | 200281740 | Y1 | 7/2002 |

OTHER PUBLICATIONS

International Search Report for PCT/US2009/061176 dated May 10, 2010.

Written Opinion of the International Searching Authority for PCT/US2009/061176 dated May 10, 2010.

* cited by examiner

*Primary Examiner* — Gene Kim
*Assistant Examiner* — Urszula M Cegielnik
(74) *Attorney, Agent, or Firm* — Cantor Colburn LLP

(57) ABSTRACT

A toy vehicle is disclosed. It has a main vehicle body portion and a display device rotatably mounted to the main body portion, the display device being configured to create a plurality of images via a persistence of vision effect. A mechanism is also present for rotating said display device. An actuator is included and is attached to a sensor for determining when the actuator is depressed. A microcontroller is in operable communication with the sensor and the display device; the microcontroller changing the appearance of at least one of the plurality of images when the sensor determines the actuator has been depressed.

17 Claims, 5 Drawing Sheets

TOY WITH AUDIO AND VISUAL FEEDBACK

CROSS REFERENCE TO RELATED APPLICATIONS

This application claims the benefit of U.S. Provisional Application Ser. No. 61/106,548, filed Oct. 17, 2008, the contents of which are incorporated by reference herein.

BACKGROUND

Various embodiments of the present invention are directed to a toy, in particular, a toy that stimulates the senses of a user. Games and toys that involve launching objects into the air or at a target are perennially popular games with all users, be they a child or an adult. Both children and adults also enjoy toys that stimulate other senses and have changing visual appearances and/or sound effects. Typical toy projectile launchers utilize foam darts or disks that are expelled from the launcher by any number of mechanisms. Other popular toys are housed in facsimiles of real objects. These might include, ships or planes or other police or military inspired objects. Such games are sometimes capable of launching or throwing objects or projectiles.

Accordingly, it is desirable to provide a toy that utilizes a projectile launcher while stimulating the senses of the user.

SUMMARY OF THE INVENTION

According to one aspect of the invention a toy vehicle having a main vehicle body portion and a display device rotatably mounted to the main body portion is provided. The display device is configured to create a plurality of images via a persistence of vision effect. A mechanism is also present for rotating the display device. An actuator is included and is attached to a sensor for determining when the actuator is depressed. A controller is in operable communication with the sensor and the display device; the controller changes the appearance of at least one of the plurality of images when the sensor determines the actuator has been depressed.

According to another aspect of the invention, an amusement device is provided. It comprises a main body portion having a projectile launcher and a display device rotatably mounted to the main body portion, the display device being configured to create a plurality of images via a persistence of vision effect. The amusement device includes a mechanism for rotating the display device, an actuator and a sensor for determining when the actuator is depressed. A controller is in operable communication with the sensor and the display device. The controller changes the appearance of at least one of the plurality of images when the sensor determines the actuator has been depressed.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1A:
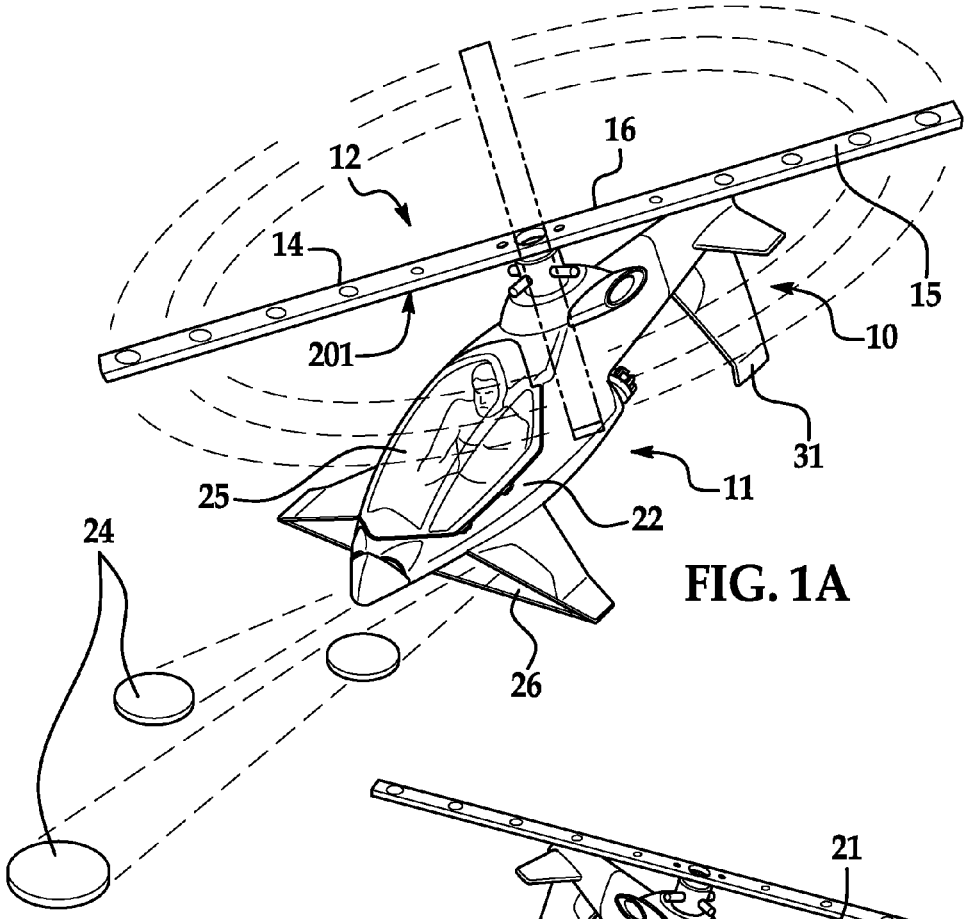
FIGS. 1A-1D show multiple illustrations of an amusement device in accordance with the invention.
Figure 1B:
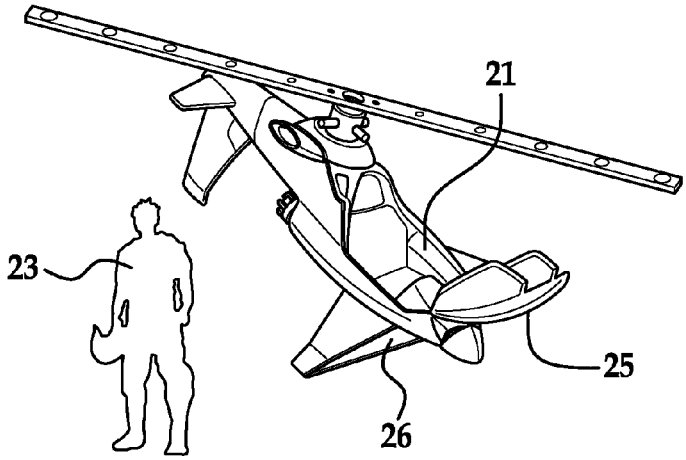
Figure 1C:
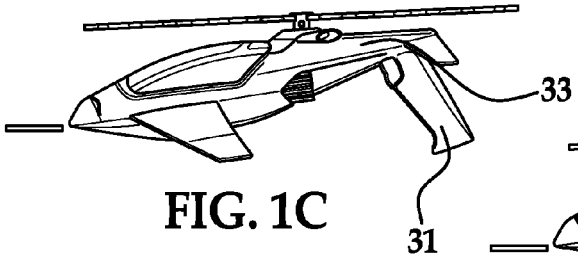
Figure 1D:
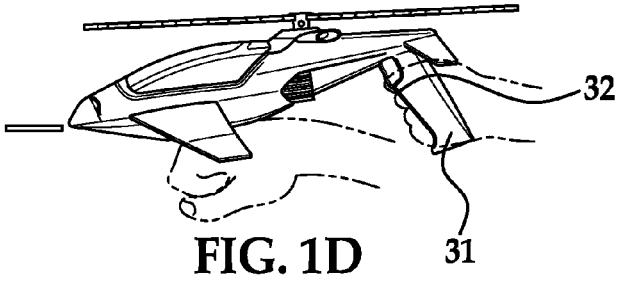
Figure 2:
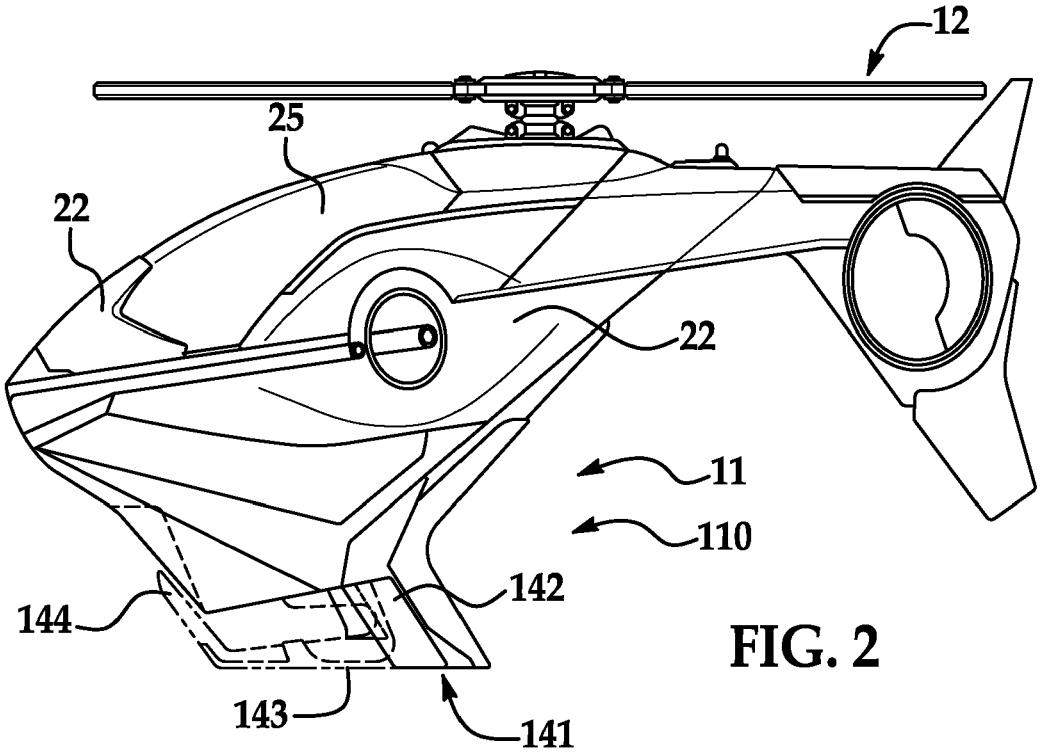
FIG. 2 is a side view of the invention.

Referring now to FIGS. 1A-1D, where the invention will be described with reference to specific embodiments, without limiting same, an amusement toy in the shape of a miniature helicopter 10 is shown. As seen in FIGS. 1A-1D, helicopter 10 includes a main body portion 11 and a display device 12 mounted to the main body portion 11, rotational display system or display device 12 being included on individual rotors 14 and 15 of a propeller 16. Miniature helicopter 10 includes a compartment 21 in the main fuselage 22 to house an action FIG. 23, compartment 21 being accessed through helicopter windscreen 25, which is pivotably mounted to main fuselage 22.

Helicopter 10 is capable of firing in the exemplary embodiment shown, foam disc projectiles 24 from a firing portion 26 that is below fuselage 22 in main body portion 11. It is of course, understood that the projectiles 24 may be configured to have any shape suitable for firing and the projectiles may be formed from any suitable material such as plastic, foam, etc and equivalents thereof. Helicopter 10 is held at a pistol grip 31 having a trigger 32 at a tail end 33 of main body portion 11. In the embodiment shown, depressing trigger 32 activates both propeller 16 and firing portion 26 to launch projectiles 24. It will be appreciated that a separate motor 222 can also drive propeller 16. Individual rotors 14 and 15 include an electric LED display 201, which will be described in detail herein.

Figure 8:
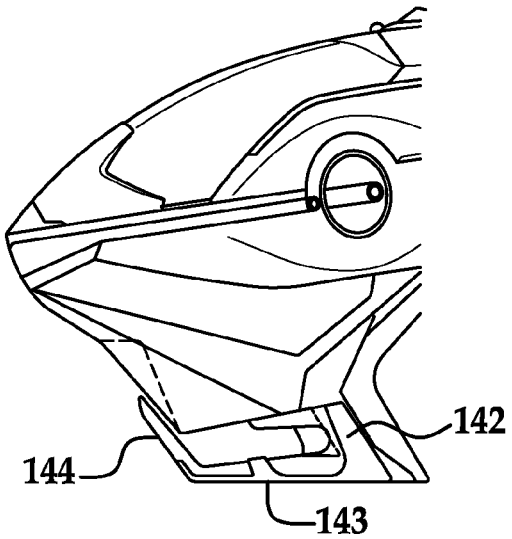
FIGS. 8 and 9 are side views of one aspect of the invention.
Figure 9:
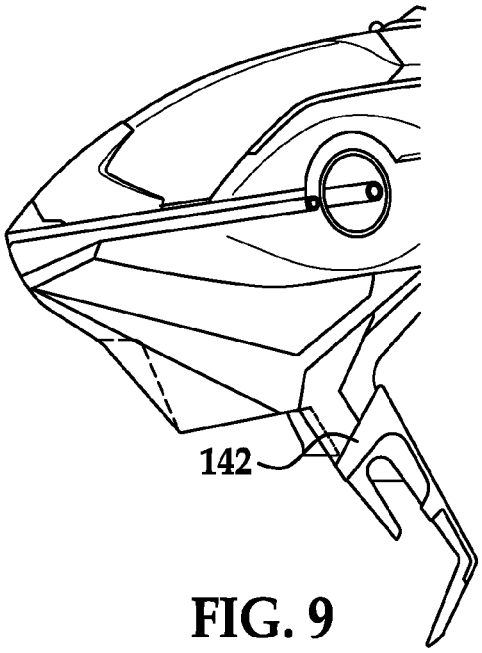
Figure 10:
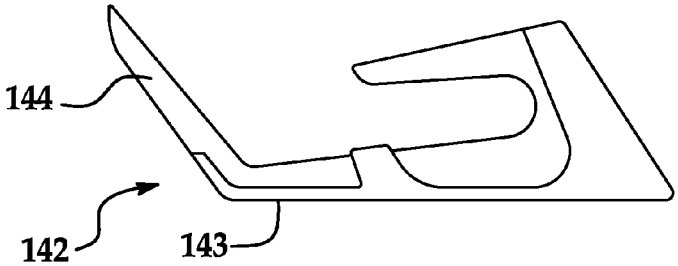
FIGS. 10, 11 and 12 are side, top and front views of another element of the invention.
Figure 11:
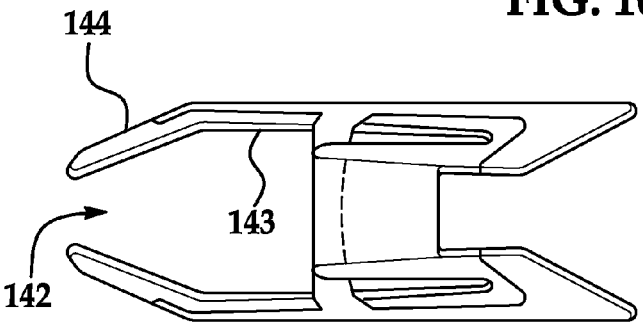
Figure 12:
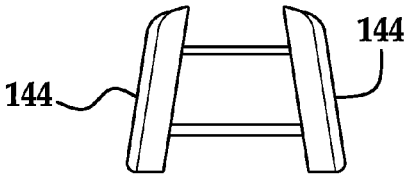
Figure 13A:
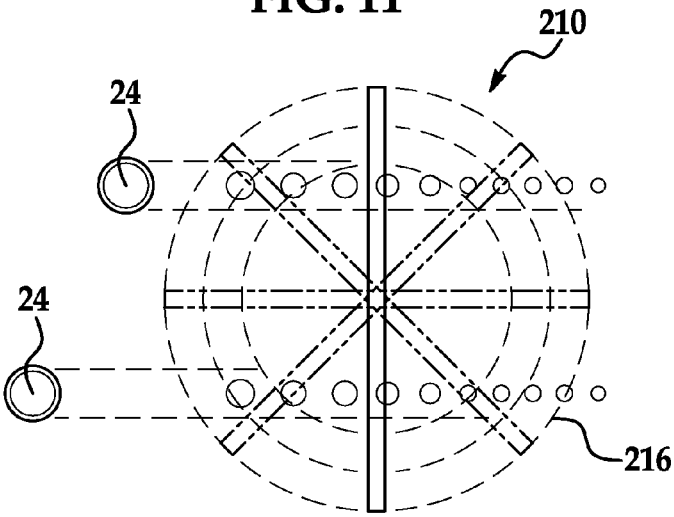
FIGS. 13A and 13B are top and side views, respectively, of one aspect of the invention.
Figure 13B:
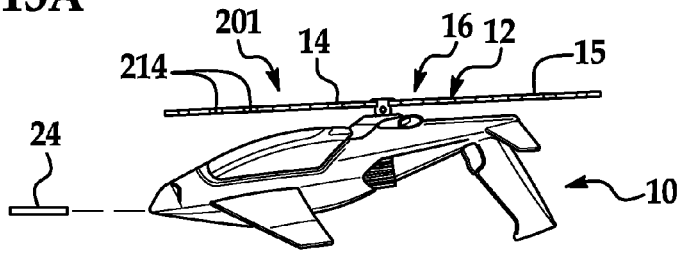
Figure 14A:
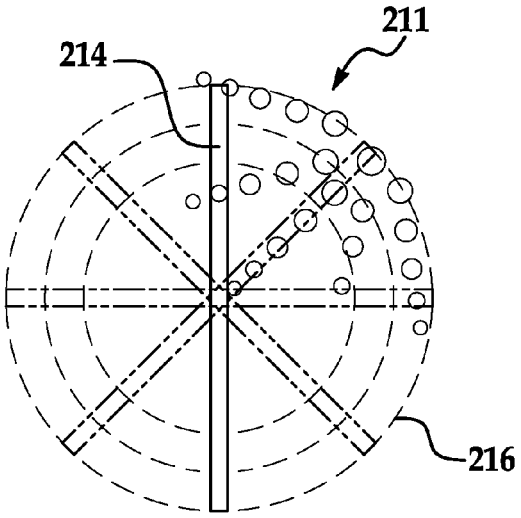
FIGS. 14A and 14B are top and side views, respectively, of another aspect of the invention.
Figure 14B:
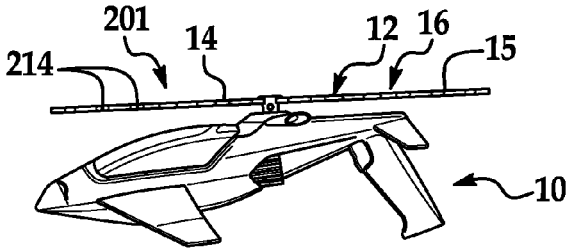

Referring now to FIGS. 2 through 7, where like numerals will be used for like elements, an alternative embodiment of helicopter 110 is shown. Main body portion 11 of helicopter 110 includes a landing gear 141 that is pivotably connected to main fuselage 22 at a pivot point 142. Landing gear 141 includes a resting surface 143 and an upturned tip 144 to form a ski shaped surface when miniature helicopter 110 is in a display position. When it is desired to use miniature helicopter 110, landing gear 141 as shown in FIG. 8 to a rotated position, as shown in FIG. 9. Landing gear 141 is locked into the rotated position of FIG. 9 in order to form a support handle. FIGS. 10, 11 and 12 include additional features of landing gear 141. It will be appreciated that landing gear 141 may take any one of a number shapes and may include a trigger to activate or launch projectiles 24.

Figure 3:
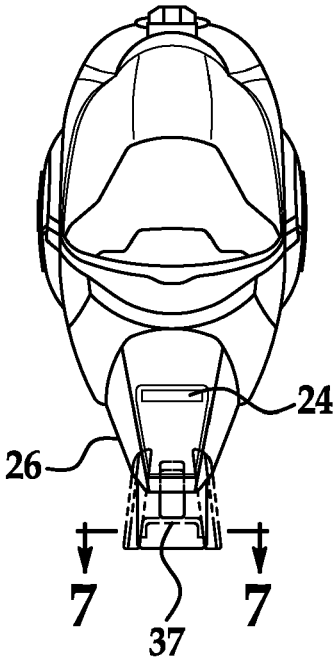
FIG. 3 is a front view of the invention.
Figure 4:
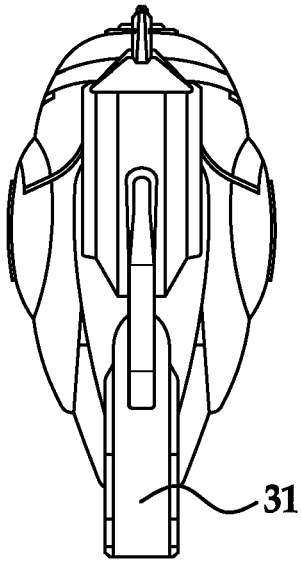
FIG. 4 is a rear view of the invention.
Figure 5:
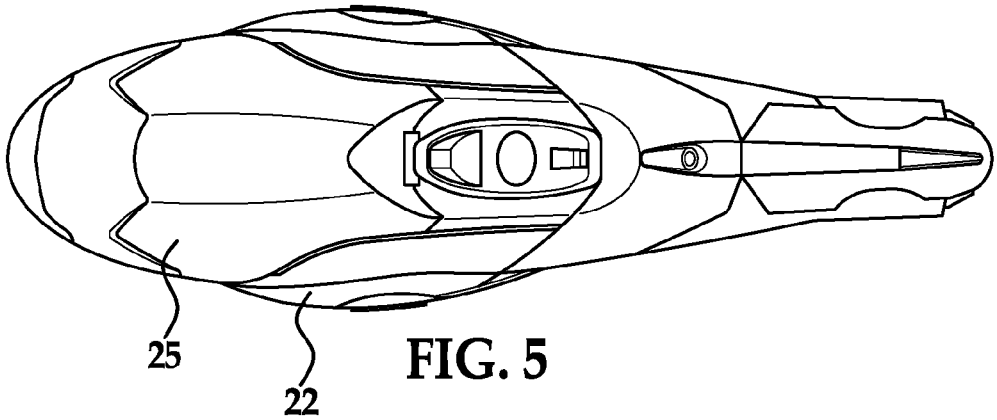
FIG. 5 is a top view of the invention.
Figure 6:
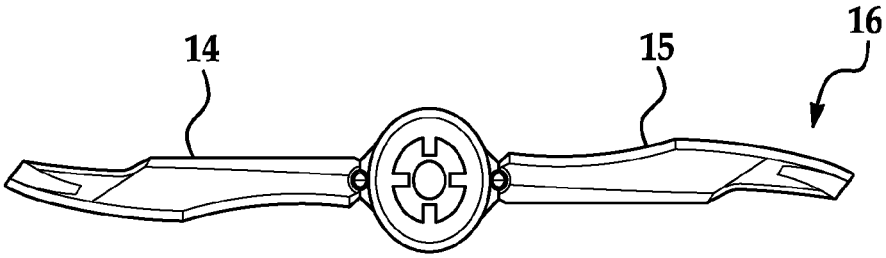
FIG. 6 is a top view of one aspect of the invention.
Figure 7:
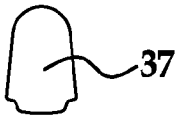
FIG. 7 is a view taken along section A-A of FIG. 3.

Referring now specifically to FIGS. 3 and 7 details of firing portion 26 are shown. Projectiles 24 are generally launched forward from firing portion 26 above landing gear 142. Projectiles 24 are loaded and kept in a firing position via a spring biased detent 39, shown in FIG. 7.

Referring now to FIGS. 13A-13B, 14A-14B and 15, an electric LED system 201 is fixed to display device 12. The display device 12 is capable of creating a plurality of images 210 or 211 or any number of variants via a persistence of vision effect. The effect is created by a rotating display device 12, in this instance propeller 16 of miniature helicopter 10. LED electric elements 214 are intermittently illuminated while located on individual rotors 14 and 15 of propeller 16. The rotation of the display device 12, combined with rapidly changing illuminated segments on rotors 14 and 15 produces a series of flashing frames that blend together to form a recognizable image, as seen by the human eye, or series of animated images 210, 211 that may move around the display area. Devices that utilize persistence of vision technology receive electronic information about an image to be displayed and the information is used to synchronize the illumination of individual illuminating elements 214 at specific positions during rotation of the assembly or device 12.

As shown in FIGS. 13 and 14, propeller 16 is rotated with the plurality of LEDs 214 disposed on the individual rotors 14 and 15. As the propeller 16 rotates, the blur perceived by the eye makes the propeller appear to be a flat, virtual circle 216, as seen in FIGS. 13 and 14. This virtual circle 216 formed by the rotating propeller 16 forms visual images 210 and 211, when brightness and timing of the LEDs 214 on sections of rotors 14 and 15 are properly synchronized.

Figure 15:
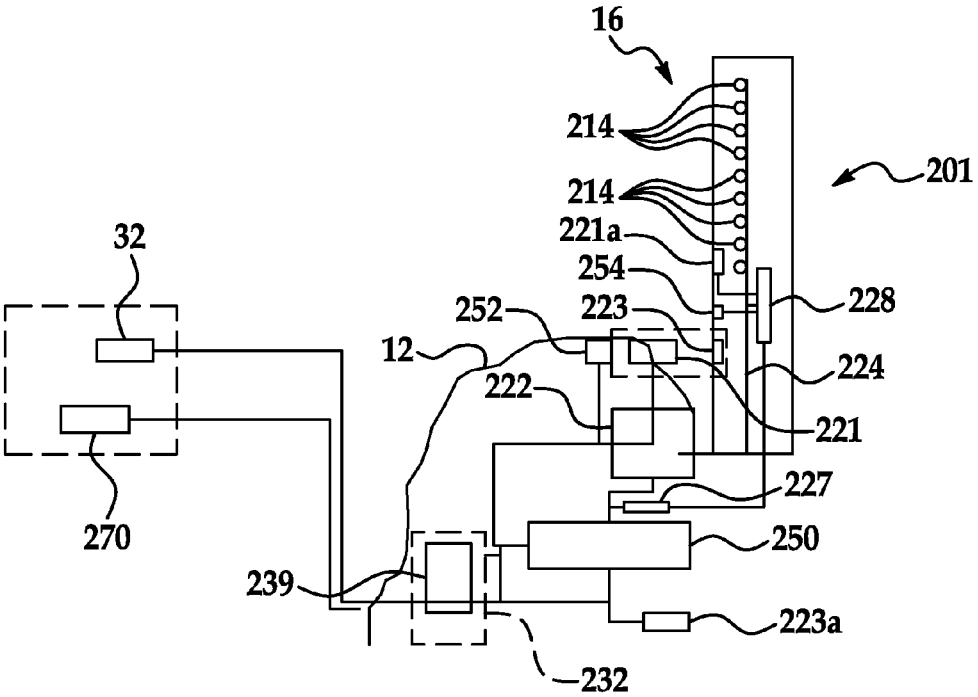
FIG. 15 is a schematic illustration of yet another aspect of the invention.

As best seen in FIG. 15, in order to provide a rotational force to the rotational display system and in order to provide visual images, a motor 222 is provided. Motor 222 is contained within main body portion 11 or at the base of rotating display device 12 to supply the rotational force to the display device 12.

In the exemplary embodiment shown, the display device comprises a flexible circuit 224 with a plurality of electric LED illuminating devices 214 coupled to a power supply 227. A controller or microcontroller 228 is in operable communication with the sensor and the plurality of illuminating devices 214. This creates a plurality of images 210 and 211 as the rotors 14 and 15 are rotated, by microcontroller 228 selectively illuminating a plurality of illuminating devices 214 disposed on the display device 12. The power supply 227 also provides the necessary power to motor 222 and any of the other devices requiring power, including microcontrollers 228, a sound system 232, illuminating devices 214 or other device add-ons.

As used herein, the term "controller" or "microcontroller" refers to an application specific integrated circuit (ASIC), electronic circuit, a processor (shared, dedicated, or group) and memory that executes one or more software or firmware programs/algorithms, a combinational logic circuit, and/or other suitable components that provide the described functionality.

For all general purposes, the term "signal" as used herein is defined as any electrical signal or any stored or transmitted value. For example, a signal can comprise a voltage, or a current. Further, a signal can comprise any stored or transmitted value such as binary values, scalar, values, or the like.

As further illustrated, display device 12 also comprises a sound system 232 for playing a plurality of sound effects through a speaker 239. In the embodiment shown, each of the plurality of sound effects correspond to at least one of the plurality of images 210, 211. For example, the sound effects may simulate that of a missile launched from helicopter 10. The sound system is controlled by the microcontroller 228.

In one exemplary embodiment, a sensor 221 is positioned to detect the presence of a source 223 secured to helicopter 10. Sensor 221 senses a rotational speed of the device and provides a digital or analog signal as the source 223 is sensed by the sensor 221. Controller 228 receives the signal or frequency of sensor 226 Controller 228 then determines and/or regulates a rotational speed of the display device 12. In the non-limiting embodiment of FIG. 15, the sensor 221 is a hall effect sensor and source 223 is a magnet. The digital or analog signal is activated, engaged or triggered by magnet 223 and the signal or frequency thereof is used to determine and/or regulate a rotational speed of the display device 12. Alternatively, other equivalent sensing devices are contemplated, including optical sensors, inductive sensors, etc.

As further shown in FIG. 15, controller 228 also receives signals from a second hall effect sensor 221*a*, which is positioned to detect the presence of magnet 223*a* fixedly mounted to the structure, in order to determine the rotational speed of the display system 12 and for purposes of illuminating the light devices 214 in sequence to provide the desired visual effect.

In accordance with known principles, the hall effect sensor 221*a* will provide a digital or analog signal to the microcontroller 228 as the magnet 223*a* is detected by the sensor 221*a* in a full rotation. An algorithm contained within the controller 228 is adapted to determine the rotational speed of the display device 12. Thus, the sequence of the illuminating devices 214 can be operated (e.g., turned off and on) to provide the desired visual effect. Of course, any non-hall effect sensor or device capable of registering equivalent positional feedback and any light source, including the LEDs illustrated, is considered to be within the scope of embodiments of this invention.

In another embodiment, the helicopter 10 may further comprise a second controller 250. Controller 250 is in operable communication with the first microcontroller 228 via a transmitter 252 and a receiver 254 to provide signals to the display device 12 which, in the embodiment illustrated, instructs display device 12 to provide certain images in accordance with the invention.

A sensor 221 detects source 223 and provides a signal to the second microcontroller 250, which detects the rotational speed of the display device 12 by counting sensor input pulses compared to an internal timer of micro controller 250. Sensor 221*a* on the display device 12 detects source 223*a* and provides a signal to the first microcontroller 228, which detects the sensor input and uses it as a position reference to begin outputting image data to the LEDs 214 to create a correctly timed display.

The sound system 232 is also operated by signals received from the second microcontroller 250. The images displayed by the rotational display system 12 are controlled by the first microcontroller 228 in response to the signals received from the receiver 254. In other words, the microcontroller 228 of the display device 12 illuminates the light in illuminating devices 214 in response to the rotational speed to provide images via a persistence of vision effect. At about the same time, the second microcontroller 250 provides signals to the controller 228 indicating what images controller 228 is to provide to display device 12. In accordance with another aspect of this embodiment, transmitter 252 and receiver 254 are infrared (IR) devices. Of course, other equivalent transmitting devices are considered to be within the scope of the present invention.

With further reference to FIG. 15, a sensor or microswitch 270 is positioned to be actuated by depressing the trigger 32, thereby providing a signal indicative of the movement of trigger 32 and when projectiles 24 have been launched. As shown, schematically in FIG. 15, sensor 270 and the movement of trigger 32 are coupled to microcontroller 250 which is adapted to provide a signal indicative of when, and in what direction, the projectiles 24 are being launched. Furthermore, controller 250 will have information pertaining to the location of the target image via operational protocols resident upon the controller 250. This information is transmitted to microcontroller 228 via transmitter 252 and receiver 254 or any other equivalent device. Accordingly, an image is displayed on display device 12 which is indicia of projectile 24, as seen in image 210, can correspond to the direction of projectile 24, as seen in images 210 and 211 or can simply indicate the direction of projectile 24, with any indicia, as seen in image 211 all created by the persistence of vision effect.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

What is claimed is:

1. A toy vehicle comprising:

a main body portion;

a display device rotatably mounted to said main body portion, the display device being configured to create a plurality of images via a persistence of vision effect;

a mechanism for rotating said display device;

an actuator;

a first sensor configured to determine when said actuator is depressed;

a controller in operable communication with the first sensor and the display device, the controller changing the appearance of at least one of the plurality of images when the first sensor determines the actuator has been depressed and provides a first signal to the controller; and a rotational feedback sensor positioned to interact with the display device in order to determine a rotational seed of the display device, the rotational feedback sensor being independent and distinct from the first sensor and being in operable communication with the controller, wherein the controller based upon a second signal received from the rotational feedback sensor corresponding to said rotational speed of said display device causes said at least one of said plurality of images to coordinate with the rotational speed of the display device.

2. The toy vehicle of claim 1, wherein said actuator activates a projectile launcher attached to said main body portion.

3. The toy vehicle of claim 2, wherein said one of said plurality of images is indicia indicating showing a projectile.

4. The toy vehicle of claim 1, wherein said main body portion is in the shape of a miniature helicopter body and said display device is in the shape of at least one rotor of a miniature helicopter.

5. The toy vehicle of claim 1, wherein said mechanism for rotating said display device is a motor housed in said main body portion.

6. The toy vehicle of claim 1, wherein said actuator is a trigger mounted on said main body portion.

7. The toy vehicle of claim 1, wherein said actuator also activates said mechanism for rotating said display device.

8. The toy vehicle of claim 1, further comprising a sound system for playing at least one sound effect, said at least one sound effect being activated when said actuator is depressed.

9. The toy vehicle of claim 1, further comprising a sound system for playing a plurality of sound effects, each said one of said plurality of sound effects corresponding to at least one of said plurality of images.

10. The toy vehicle of claim 1, wherein said actuator activates a projectile launcher attached to said main body portion and one of said plurality of images is visually displayed to indicate a direction, the direction being the same as that in which the projectile has been launched.

11. An amusement device, comprising:

a main body portion having a projectile launcher;

a display device rotatably mounted to said main body portion, the display device being configured to create a plurality of images via a persistence of vision effect;

a mechanism for rotating said display device;

an actuator;

a first sensor configured to determine when said actuator is depressed;

a controller in operable communication with the first sensor and the display device, the controller changing the appearance of at least one of the plurality of images when the first sensor determines the actuator has been depressed and provides a first signal to the controller; and a rotational feedback sensor positioned to interact with the display device in order to determine a rotational seed of the display device, the rotational feedback sensor being independent and distinct from the first sensor and being in operable communication with the controller, wherein the controller based upon a second signal received from the rotational feedback sensor corresponding to said rotational speed of said display device causes said at least one of said plurality of images to coordinate with the rotational speed of the display device.

12. The amusement device of claim 11, wherein said actuator activates said projectile launcher.

13. The amusement device of claim 12, wherein said one of said plurality of images is indicia indicating showing a projectile.

14. The amusement device of claim 11, wherein said actuator activates said projectile launcher and one of said plurality of images is visually displayed to indicate a direction, the direction being the same as that in which the projectile has been launched.

15. The amusement device of claim 11, further comprising a sound system for playing at least one sound effect, said at least one sound effect being activated when said actuator is depressed.

16. The amusement device of claim 11, wherein said actuator is configured to activate said mechanism for rotating said display device when depressed.

17. The toy vehicle of claim 2, wherein said actuator is a trigger mounted on said main body portion.

* * * * *